United States Patent [19]

Yamamura

[11] Patent Number: 5,030,946

[45] Date of Patent: Jul. 9, 1991

[54] APPARATUS FOR THE CONTROL OF AN ACCESS TO A VIDEO MEMORY

[75] Inventor: Kimio Yamamura, Tokyo, Japan

[73] Assignee: Hudson Soft Co., Ltd., Hokkaido, Japan

[21] Appl. No.: 174,686

[22] Filed: Mar. 29, 1988

[30] Foreign Application Priority Data

May 20, 1987 [JP] Japan ..... 62-123049
Sep. 19, 1987 [JP] Japan ..... 62-235483

[51] Int. Cl.[5] ..... G09G 1/14

[52] U.S. Cl. ..... 340/750; 340/799; 340/748

[58] Field of Search ..... 340/750, 748, 798, 799

[56] References Cited

U.S. PATENT DOCUMENTS 4,104,624 8/1978 Hamada ..... 340/750
4,485,378 11/1984 Matsui et al. ..... 340/750
4,660,156 4/1987 Bond et al. ..... 348/799
4,737,780 4/1988 Ishii ..... 340/750

OTHER PUBLICATIONS

Artwick, "Microcomputer Displays, Graphics, and Animation", Prentice-Hall Inc., New Jersey, 1984, pp. 14-15.

*Primary Examiner*—Alvin E. Oberley
*Attorney, Agent, or Firm*—Lowe, Price, LeBlanc and Becker

[57] ABSTRACT

An apparatus for the control of an access to a video memory comprises a memory width register having a content of a number of dot periods by which an access timing is determined to address a video memory. Therefore, an access timing is easily controlled dependent on a memory speed of the video memory only by changing the content of the memory width register. When the video memory is accessed during a display cycle of the video memory, video data may be stored in a buffer memory, and transferred from the buffer memory after the display cycle is finished.

15 Claims, 17 Drawing Sheets

FIG. 3 A

ADDRESS REGISTER

| MSB | | | | | | | | | | | | | | | LSB |
|---|---|---|---|---|---|---|---|---|---|---|---|---|---|---|---|
| 15 | 14 | 13 | 12 | 11 | 10 | 9 | 8 | 7 | 6 | 5 | 4 | 3 | 2 | 1 | 0 |
| | | | | | | | | | | | AR | | | | |

FIG. 3 B

STATUS REGISTER

| MSB | | | | | | | | | | | | | | | LSB |
|---|---|---|---|---|---|---|---|---|---|---|---|---|---|---|---|
| 15 | 14 | 13 | 12 | 11 | 10 | 9 | 8 | 7 | 6 | 5 | 4 | 3 | 2 | 1 | 0 |
| ← 0 → | | | | | | | | | BSY | VD | DV | DS | RR | OR | CR |

FIG. 3 C

MEMORY ADDRESS WRITE REGISTER

| MSB | | | | | | | | | | | | | | | LSB |
|---|---|---|---|---|---|---|---|---|---|---|---|---|---|---|---|
| 15 | 14 | 13 | 12 | 11 | 10 | 9 | 8 | 7 | 6 | 5 | 4 | 3 | 2 | 1 | 0 |
| MAWR | | | | | | | | | | | | | | | |

FIG. 3 D

MEMORY ADDRESS READ REGISTER

| MSB | | | | | | | | | | | | | | | LSB |
|---|---|---|---|---|---|---|---|---|---|---|---|---|---|---|---|
| 15 | 14 | 13 | 12 | 11 | 10 | 9 | 8 | 7 | 6 | 5 | 4 | 3 | 2 | 1 | 0 |
| MARR | | | | | | | | | | | | | | | |

FIG. 3E

VRAM DATA WRITE REGISTER

| MSB | | | | | | | | | | | | | | | LSB |
|---|---|---|---|---|---|---|---|---|---|---|---|---|---|---|---|
| 15 | 14 | 13 | 12 | 11 | 10 | 9 | 8 | 7 | 6 | 5 | 4 | 3 | 2 | 1 | 0 |
| VWR | | | | | | | | | | | | | | | |

FIG. 3F

VRAM DATA READ REGISTER

| MSB | | | | | | | | | | | | | | | LSB |
|---|---|---|---|---|---|---|---|---|---|---|---|---|---|---|---|
| 15 | 14 | 13 | 12 | 11 | 10 | 9 | 8 | 7 | 6 | 5 | 4 | 3 | 2 | 1 | 0 |
| VRR | | | | | | | | | | | | | | | |

FIG. 3G

CONTROL REGISTER

| MSB | | | | | | | | | | | | | | | LSB |
|---|---|---|---|---|---|---|---|---|---|---|---|---|---|---|---|
| 15 | 14 | 13 | 12 | 11 | 10 | 9 | 8 | 7 | 6 | 5 | 4 | 3 | 2 | 1 | 0 |
| X | X | X | IW | | DR | TE | | BB | SB | EX | | IE | | | |

FIG. 3H

RASTER DETECTING REGISTER

| MSB | | | | | | | | | | | | | | | LSB |
|---|---|---|---|---|---|---|---|---|---|---|---|---|---|---|---|
| 15 | 14 | 13 | 12 | 11 | 10 | 9 | 8 | 7 | 6 | 5 | 4 | 3 | 2 | 1 | 0 |
| X | X | X | X | X | X | RCR | | | | | | | | | |

FIG. 3I

BGX SCROLL REGISTER

| MSB | | | | | | | | | | | | | | | LSB |
|---|---|---|---|---|---|---|---|---|---|---|---|---|---|---|---|
| 15 | 14 | 13 | 12 | 11 | 10 | 9 | 8 | 7 | 6 | 5 | 4 | 3 | 2 | 1 | 0 |
| | | | | | | BXR | | | | | | | | | |

FIG. 3J

BGY SCROLL REGISTER

| MSB | | | | | | | | | | | | | | | LSB |
|---|---|---|---|---|---|---|---|---|---|---|---|---|---|---|---|
| 15 | 14 | 13 | 12 | 11 | 10 | 9 | 8 | 7 | 6 | 5 | 4 | 3 | 2 | 1 | 0 |
| | | | | | | | BYR | | | | | | | | |

FIG. 3K

MEMORY WIDTH REGISTER

| MSB | | | | | | | | | | | | | | | LSB |
|---|---|---|---|---|---|---|---|---|---|---|---|---|---|---|---|
| 15 | 14 | 13 | 12 | 11 | 10 | 9 | 8 | 7 | 6 | 5 | 4 | 3 | 2 | 1 | 0 |
| | | | | | | | | CM | SCREEN | | | SM | | VM | |

FIG. 3L

HORIZONTAL PERIOD REGISTER

| MSB | | | | | | | | | | | | | | | LSB |
|---|---|---|---|---|---|---|---|---|---|---|---|---|---|---|---|
| 15 | 14 | 13 | 12 | 11 | 10 | 9 | 8 | 7 | 6 | 5 | 4 | 3 | 2 | 1 | 0 |
| | HDS | | | | | | | | | | HSW | | | | |

FIG. 3M

HORIZONTAL DISPLAY REGISTER

| MSB | | | | | | | | | | | | | | | LSB |
|---|---|---|---|---|---|---|---|---|---|---|---|---|---|---|---|
| 15 | 14 | 13 | 12 | 11 | 10 | 9 | 8 | 7 | 6 | 5 | 4 | 3 | 2 | 1 | 0 |
| X | HDE | | | | | | | X | HDW | | | | | | |

FIG. 3N

VERTICAL SYNCHRONISM REGISTER

| MSB | | | | | | | | | | | | | | | LSB |
|---|---|---|---|---|---|---|---|---|---|---|---|---|---|---|---|
| 15 | 14 | 13 | 12 | 11 | 10 | 9 | 8 | 7 | 6 | 5 | 4 | 3 | 2 | 1 | 0 |
| VDS | | | | | | | | X | | | VSW | | | | |

FIG. 3O

VERTICAL DISPLAY REGISTER

| MSB | | | | | | | | | | | | | | | LSB |
|---|---|---|---|---|---|---|---|---|---|---|---|---|---|---|---|
| 15 | 14 | 13 | 12 | 11 | 10 | 9 | 8 | 7 | 6 | 5 | 4 | 3 | 2 | 1 | 0 |
| X | | | | | | | VDW | | | | | | | | |

FIG. 3P

VERTICAL DISPLAY END POSITION REGISTER

| MSB | | | | | | | | | | | | | | | LSB |
|---|---|---|---|---|---|---|---|---|---|---|---|---|---|---|---|
| 15 | 14 | 13 | 12 | 11 | 10 | 9 | 8 | 7 | 6 | 5 | 4 | 3 | 2 | 1 | 0 |
| X | | | | | | | | VCR | | | | | | | |

FIG. 3Q

DMA CONTROL REGISTER

| MSB | | | | | | | | | | | | | | | LSB |
|---|---|---|---|---|---|---|---|---|---|---|---|---|---|---|---|
| 15 | 14 | 13 | 12 | 11 | 10 | 9 | 8 | 7 | 6 | 5 | 4 | 3 | 2 | 1 | 0 |
| | | | | | | | | | | | DSR | DI/D | SI/D | DVC | DSC |

FIG. 3R

DMA SOURCE ADDRESS REGISTER

| MSB | | | | | | | | | | | | | | | LSB |
|---|---|---|---|---|---|---|---|---|---|---|---|---|---|---|---|
| 15 | 14 | 13 | 12 | 11 | 10 | 9 | 8 | 7 | 6 | 5 | 4 | 3 | 2 | 1 | 0 |
| SOUR | | | | | | | | | | | | | | | |

FIG. 3S

DMA DESTINATION ADDRESS REGISTER

| MSB | | | | | | | | | | | | | | | LSB |
|---|---|---|---|---|---|---|---|---|---|---|---|---|---|---|---|
| 15 | 14 | 13 | 12 | 11 | 10 | 9 | 8 | 7 | 6 | 5 | 4 | 3 | 2 | 1 | 0 |
| DESR | | | | | | | | | | | | | | | |

FIG. 3T

DMA BLOCK LENGTH REGISTER

| MSB | | | | | | | | | | | | | | | LSB |
|---|---|---|---|---|---|---|---|---|---|---|---|---|---|---|---|
| 15 | 14 | 13 | 12 | 11 | 10 | 9 | 8 | 7 | 6 | 5 | 4 | 3 | 2 | 1 | 0 |
| LENR | | | | | | | | | | | | | | | |

FIG. 3U

DMA VRAM-SATB SOURCE ADDRESS REGISTER

| MSB | | | | | | | | | | | | | | | LSB |
|---|---|---|---|---|---|---|---|---|---|---|---|---|---|---|---|
| 15 | 14 | 13 | 12 | 11 | 10 | 9 | 8 | 7 | 6 | 5 | 4 | 3 | 2 | 1 | 0 |
| DVSSR | | | | | | | | | | | | | | | |

| MSB | | | | | | | | | | | | | | | LSB |
|---|---|---|---|---|---|---|---|---|---|---|---|---|---|---|---|
| 15 | 14 | 13 | 12 | 11 | 10 | 9 | 8 | 7 | 6 | 5 | 4 | 3 | 2 | 1 | 0 |
| CG COLOR | | | | CHARACTER CODE | | | | | | | | | | | |

APPARATUS FOR THE CONTROL OF AN ACCESS TO A VIDEO MEMORY

FIELD OF THE INVENTION

The invention relates to an apparatus for the control of an access to a video memory, and more particularly to an apparatus for the control of an access to a video memory in which a number of dot periods is controlled at the time of an access to a video memory and/or a timing of a data transfer is controlled during a display cycle of a video memory.

BACKGROUND OF THE INVENTION

There has been used an apparatus for the control of an access to a video memory in which an access is allocated from a CPU to a video memory during the first half of four bits in a horizontal one character cycle of eight bits, and an access is allocated to a character generator of the video memory during the latter half of four bits therein. In the apparatus for the control of an access to a video memory, flickers are prevented from being occured on a screen because the writing and reading of data which are performed from the CPU to the video memory and the access to the character generator of the video memory are divided sequentially.

According to the apparatus for the control of an access to a video memory, however, there is a disadvantage that an access of the video memory can not be controlled in its timing because the access timing is fixed as mentioned before. In a personal computer in which a processing time is widely varied, for instance, from 40 ns to 139 ns dependent on a resolution of the screen, therefore, a property of the video memory is not sufficiently utilized even if the video memory is a high speed memory. On the other hand, a low speed memory can not be used in an apparatus in which a high speed memory is not required in view of a specified characteristic in a case where an access timing is fixed in a high speed mode.

There is a further disadvantage that a throughput of the CPU is decreased because the CPU has to wait the writing of data into the video memory and reading of data therefrom during a display cycle of the video memory, although flickers are prevented from being occured on the screen.

SUMMARY OF THE INVENTION

Accordingly, it is an object of the invention to provide an apparatus for the control of an access to a video memory in which an access to a video memory can be easily controlled in its timing dependent on a speed of a video memory.

It is another object of the invention to provide an apparatus for the control of an access to a video memory in which a throughput of a CPU is improved.

According to the invention, an apparatus for the control of an access to a video memory comprises, register means storing a number of dot signals for the access to a video memory, means for deciding said number of dot periods in accordance with said content of said register means, means for addressing said video memory at timings determined in accordance with said number of dot periods, and means for latching video data which are read from said video memory at said timings, wherein a pattern defined by said video data is displayed on a screen.

BRIEF DESCRIPTION OF THE DRAWINGS

The invention will be explained in detail in conjunction with drawings wherein.

DESCRIPTION OF PREFERRED EMBODIMENTS

Figure 1:
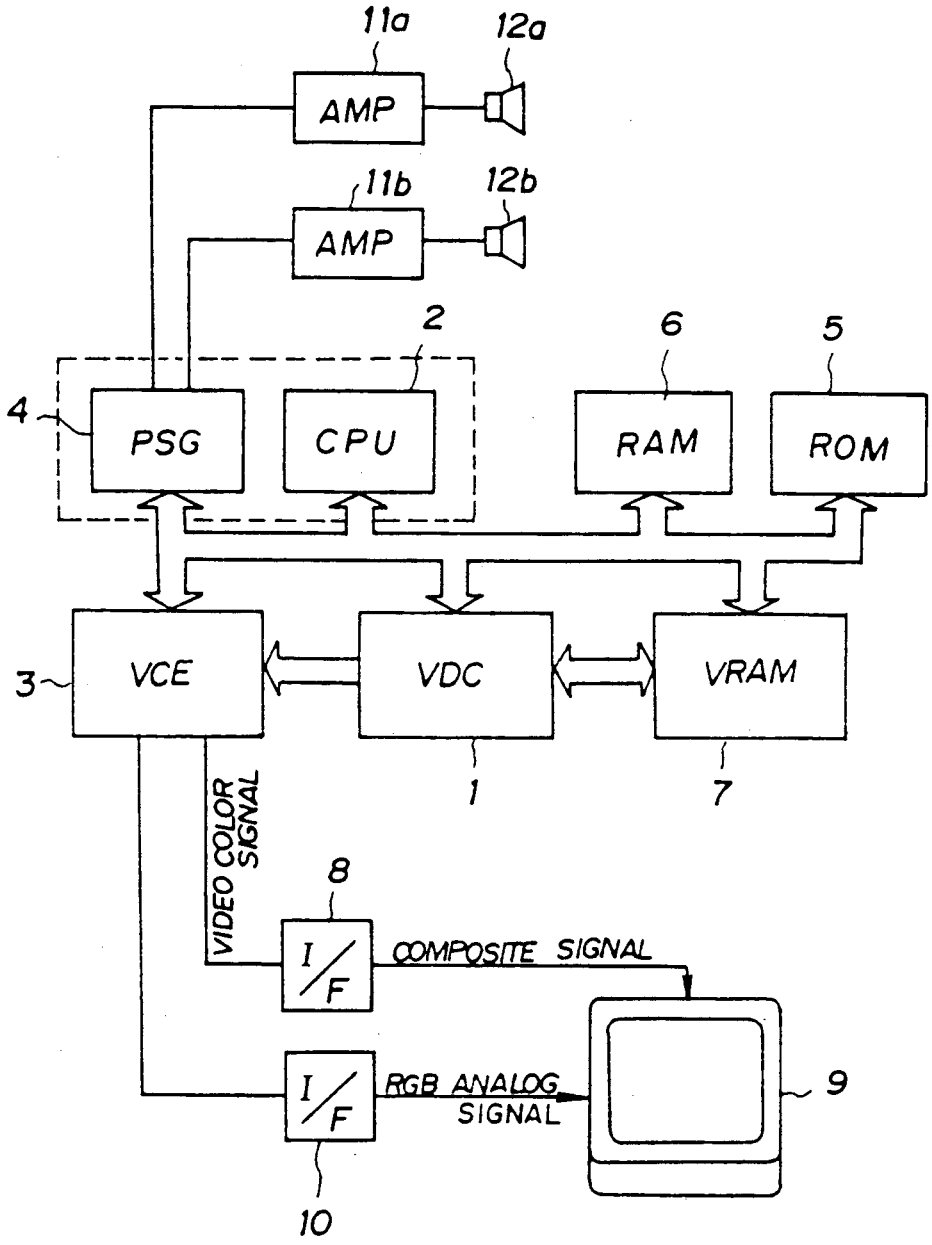
FIG. 1 is a block diagram showing an apparatus for displaying an image on a screen in which an apparatus for the control of an access to a video memory according to the invention is included.

In FIG. 1, there is shown an apparatus for displaying an image on a screen which is mainly composed of a video display controller 1, a CPU 2, a video color encoder 3, and a programable sound generator 4. The video display controller 1 supplies the video color encoder 3 with image data for a story which are read from a VRAM 7 under the control of the CPU 2 reading a program stored in a ROM 5. The CPU 2 controls a RAM 6 to store data, calculation or arithmetical results etc. temporarily in accordance with a program stored in the ROM 5. The video color encoder 3 is supplied with image data to produce RGB analog signals or video color signals including luminance signals and color difference signals to which the RGB signals are matrix-converted by using color data stored therein. The programable sound generator 4 is controlled by the CPU 2 reading a program stored in the ROM 5 to produce audio signals making left and right stereo sounds. The video color signals produced at the video color encoder 3 are of composite signals supplied through an interface 8 to a television set 9, while the RGB analog signals are directly supplied to a CRT of the television set 9 which is used as an exclusive monitor apparatus. The left and right analog signals supplied from the programable sound generator 4 are amplified at amplifiers 11*a* and 11*b* to make sounds at speakers 12*a* and 12*b*.

Figure 2A:
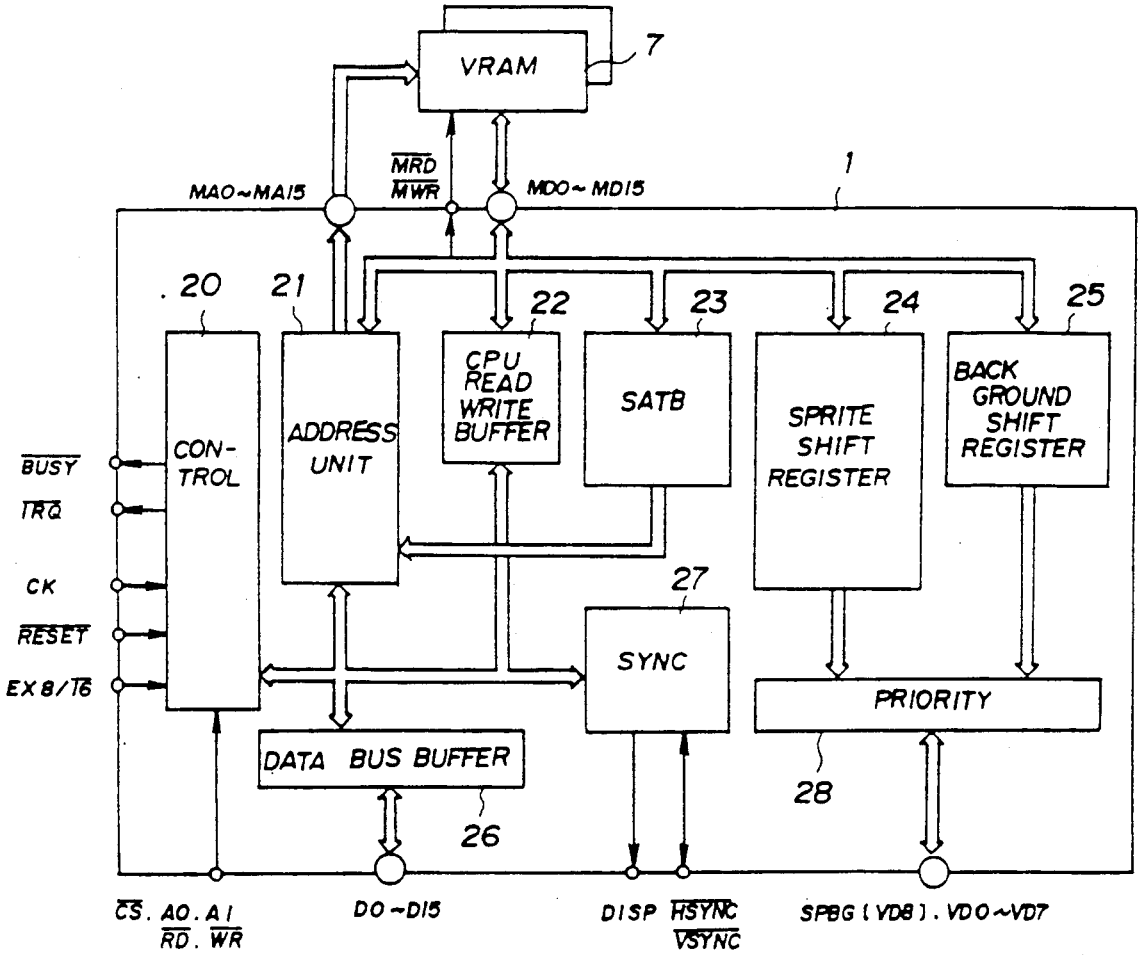
FIG. 2A is a block diagram showing a video display controller for the control of writing video signals into a VRAM and reading video signals therefrom.

In FIG. 2A, there is shown the video display controller 1 transferring data between the CPU 2 and VRAM 7 which comprises a control unit 20 including various kinds of registers to be described later, an address unit 21, a CPU read/write buffer 22, and sprite shift register 24, a background shift register 25, a data bus buffer 26, a synchronic circuit 27, and a priority circuit 28.

The control unit 20 is provided with a $\overline{\text{BUSY}}$ terminal being "L" to keep the CPU 2 writing data into the VRAM 7 or reading data therefrom in a case where the video display controller 1 is not in time for the writing or reading of the date, an $\overline{\text{IRQ}}$ terminal supplying an interruption request signal, a CK terminal receiving a clock signal of a frequency for one dot periods (one picture element), a $\overline{\text{RESET}}$ terminal receiving a reset signal for initializing the video display controller 1, and an EX 8/$\overline{16}$ terminal receiving a data bus width signal for selecting one of 8 and 16 bit data buses.

The address unit 21 is connected to terminals MAO to MA15 supplying address signals for the VRAM 7 which has, for instance, a special address region of 65,536 words. The address unit 21, CPU read/write buffer 22, sprite attribute table 23, sprite shift register 24, and background shift register 25 are connected to terminals MD 0 to MD 15 through which data are transferred to and from the VRAM 7.

The sprite attribute table buffer 23 is a memory for storing X and Y display positions, pattern codes and control data of sprites each composed of 16×16 dots as described in more detail later.

The sprite shift register 24 stores pattern and color data of a sprite read from a sprite generator in the VRAM 7 which is accessed in accordance with the pattern codes stored in the sprite attribute table 23 as described in more detail later.

The background shift register 25 stores pattern data, along with CG color, read from a character generator in the VRAM 7 in accordance with an address based on a character code of a background attribute table in the VRAM 7 which is accessed in an address decided by a raster position as also described in more detail later.

The data bus buffer 26 is connected to terminals D0 to D15 through which data are supplied and received. In the video display controller 1, 8 or 16 bit interface is selected to comply with a data width of a system including the CPU2 wherein the terminals D0 to D7 among the terminals D0 to D15 are occupied when the 8 bit interface is selected.

The synchronic circuit 27 is connected to a DISP terminal indicating a display period, a $\overline{\text{VSYNC}}$ terminal from which a vertical synchronous signal for a CRT screen is supplied and in which an external vertical synchronous signal is received, and a $\overline{\text{HSYNC}}$ terminal from which a horizontal synchronous signal for a CRT screen is supplied and in which an external horizontal synchronous signal is received.

The priority circuit 28 is connected to terminals VD0 to VD7 through which video signals are supplied, and a SPBG (VD8) terminal being "H" when the video signals are of a sprite and being "L" when the video signals are of a background.

The aforementioned control unit 20 is also connected to a $\overline{\text{CS}}$ terminal being "L" wherein the CPU 2 is able to read data from registers therein and sprite data thereinto, a $\overline{\text{RD}}$ terminal receiving a clock signal for the reading thereof, a $\overline{\text{WR}}$ terminal receiving a clock signal for the writing thereof, and terminals A0 and A1 which are connected to address bus of the CPU 2. Further, the video display controller 1 is provided with a $\overline{\text{MRD}}$ terminal being "L" when the CPU 2 reads data from the VRAM 7, and a $\overline{\text{MWR}}$ terminal being "L" when the CPU 2 writes data into the VRAM 7.

Figure 2B:
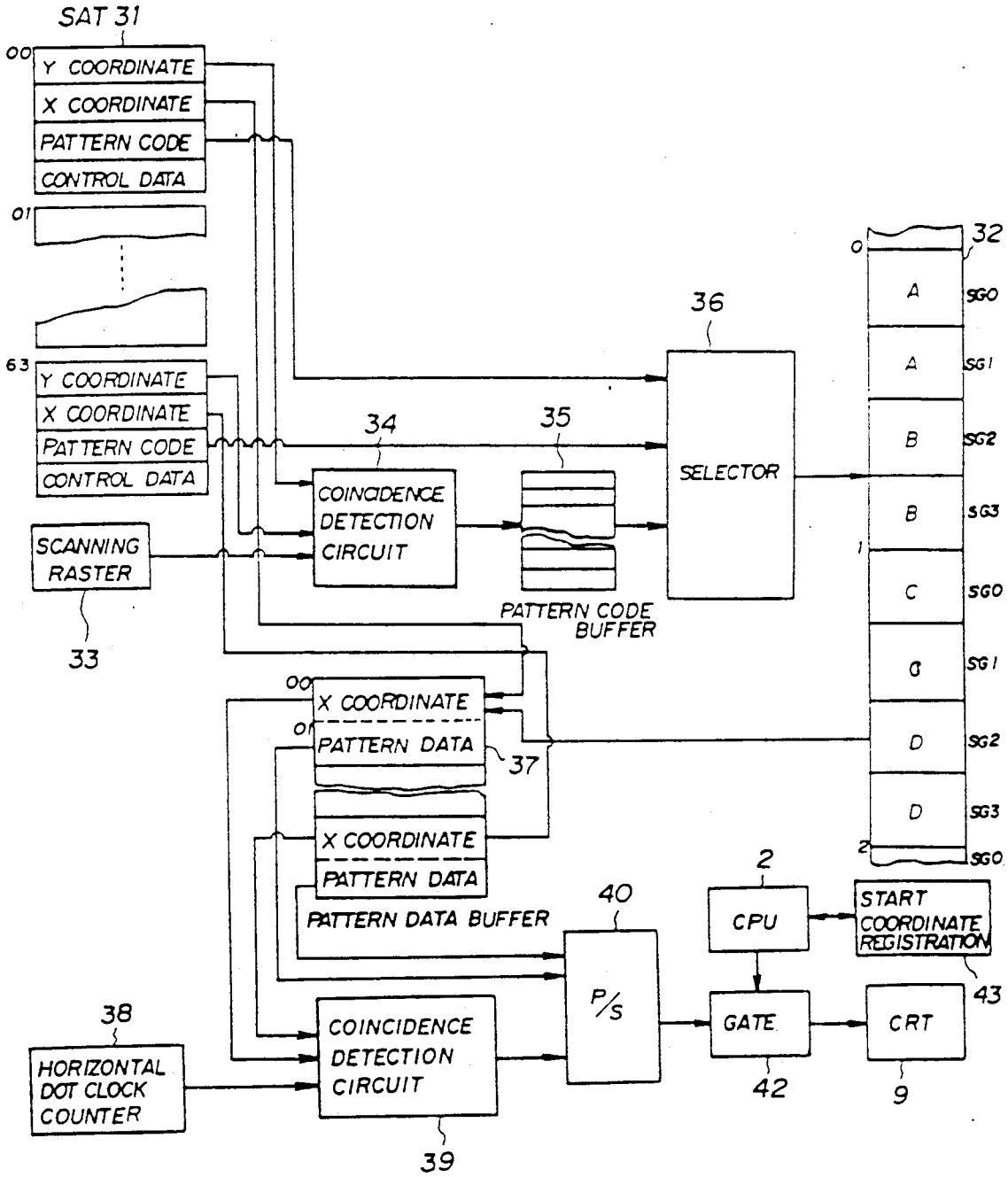
FIG. 2B is a block diagram showing an apparatus for displaying a sprite on a screen in the apparatus of FIG. 1, FIGS. 3A to 3U are explanatory diagrams showing registers included in a control unit of the video display controller in FIG. 2A.

In FIG. 2B, there is shown an apparatus for displaying a sprite on a screen which is included in the apparatus of FIG. 1 wherein the reference numerals 31 and 32 indicate a sprite attribute table and sprite generator in the VRAM 7 respectively. The sprite attribute table 31 can include, for instance, sixty-four sprites, while the sprite generator 32 can include, for instance, one thousand and twenty-four sprites. In the sprite attribute table 31, addresses of 0 to 63 are assigned to the sixty-four sprites to give a priority thereto in the order of the address $0>1>\ldots>62>63$. Each of the sprites is composed of 16×16 bits, and includes X and Y coordinates, pattern codes and control data. As to each of the sprites, the Y coordinate is compared with a raster signal supplied from a scanning raster producing circuit 33 in a coincidence detection circuit 34 whereby sprites each having a Y coordinate coincident with a raster signal are stored into a pattern code buffer 35 which can store a maximum number of sixteen sprites by referring to a corresponding one of the addresses 0 to 63. A selector 36 selects a pattern code of the sprite attribute table 31 in accordance with an address stored in the pattern code buffer 35 to access the sprite generator 32 in regard to an address which is of a selected pattern code, thereby reading pattern data from the sprite generator 32. The pattern data thus obtained are stored into a pattern data buffer 37 along with an X coordinate corresponding thereto read from the sprite attribute table 31. The storing of sprites into the pattern code buffer 35 is performed at a horizontal display period preceding to the present horizontal display period by one scanning raster, while the storing of pattern data into the pattern data buffer 37 is performed at a following horizontal retrace period. When a scanning raster at which pattern data are displayed has come, the X coordinate thus stored in the pattern data buffer 37 is compared with a counted value of a horizontal dot periods clock counter 38 in a coincidence detection circuit 39 whereby pattern data having an X coordinate coincident with the counted value are supplied to a parallel/serial converting circuit 40. In the parallel/serial converting circuit 40, parallel pattern data are converted into serial pattern data which are supplied through a gate circuit 42 to a CRT screen 9. The gate circuit 42 is controlled to be turned on and off in accordance with a content of a starting coordinates registration circuit 43 by the CPU 2. The content thereof is X and Y coordinates by which the starting coordinates of a display region is defined on a display screen.

In FIGS. 3A to 3U, there are shown various kinds of registers included in the control unit 20 of the video display controller 1.

(a) Address register (FIG. 3A)

A register number "AR" is exclusively written into the address register for designating one of memory address write register to DMA VRAM-SATB source address register as shown FIGS. 3C to 3U so that data are written into the designated register or read therefrom. The address register is selected when a signal is written into the video display controller 1 under the condition that the A1 and $\overline{CS}$ terminals thereof are "L".

In a case where 16 bit data bus is selected, the EX $8/\overline{16}$ terminal is "0", the A1 terminal is "0", the R/W terminal is W, and the A0 terminal is no matter.

In a case where 8 bit data bus is selected, the EX $8/\overline{16}$ terminal is "1", the A0 and A1 terminals are "0", and the R/W terminal is W.

(b) Status register (FIG. 3B)

A bit corresponding to one of interruption jobs is set to be "H" in the status register to make the interruption active when a cause of the interruption which is enabled by an interruption permission bit of a control register and DMA control register as shown in FIGS. 3G and 3Q is occured. When the status is read from the status register, the corresponding bit is cleared automatically. The status indicating bits are as follows.

(1) bit 0 (CR) . . . collision of sprites

It is indicated that the sprite number 0 of a sprite is collided with any one of the sprite numbers 1 to 63 of sprites.

(2) bit 1 (OR) . . . more sprites than a predetermined number (2.1) a case where more than 17 sprites are detected on a single raster line.

(2.2) a case where data of a sprite which is designated are not transferred to a data buffer in a horizontal retrace period.

(2.3) a case where a bit of CGX in control data of a sprite by which two sprites are jointed in a horizontal direction is set so that data of the sprites are not transferred to a data buffer.

(3) bit 2 (RR) . . . detection of raster

It is indicated that a value of a raster counter becomes a predetermined value of a raster detecting register.

(4) bit 3 (DS) . . . finishing of DMA transfer

It is indicated that data transfer between the VRAM 7 and sprite attribute table buffer 23 is finished.

(5) bit 4 (DV) . . . finishing of DMA transfer

It is indicated that data transfer between two regions of the VRAM 7 is finished.

(6) bit 5 (VD) . . . vertical retrace period

It is indicated that the VRAM 7 is accessed for the writing or reading of date by the CPU 2 so that the $\overline{BUSY}$ terminal is "0".

(c) Memory address write register (register number "00", FIG. 3C)

A starting address "MAWR" is written into the memory address write register so that the writing of data begins at the starting address of the VRAM 7.

(d) Memory address read register (register number "01", FIG. 3D)

A starting address "MARR" is written into the memory address read register. When the upper byte of the starting address is written thereinto, data are begun to be read from the starting address of the VRAM 7 so that data thus read are written into a VRAM data read register as shown in FIG. 3F. Thereafter, the starting address "MARR" is automatically incremented by one.

(e) VRAM data write register(register number "02", FIG. 3E)

Data which are transferred from the CPU 2 to the VRAM 7 are written into the VRAM data write register. When the upper byte of the data "VWR" is written thereinto, the video display controller 1 begins to write the data into the VRAM 7 and the address "MAWR" of the memory address write register is automatically incremented by one upon the writing of the data.

(f) VRAM data read register(register number "02", FIG. 3F)

Data which are transferred from the VRAM 7 to the CPU 2 are written into the VRAM data read register. When the upper byte of the data "VRR" is read therefrom, the reading of data is performed at the following address of the VRAM 7.

(g) Control register (register number "05", FIG. 3G)

An operating mode of the video display controller 1 is controlled in accordance with the following bits of the control register.

(1) bits 0 to 3 (IE) . . . enable of interruption request (1.1) bit 0 . . . collision detection of sprites (1.2) bit 1 . . . excess number detection of sprites (1.3) bit 2 . . . raster detection (1.4) bit 3 . . . detection of vertical retrace period (2) bits 4 and 5 (EX) . . . external synchronism

| bit 5 | bit 4 | content |
|---|---|---|
| 0 | 0 | $\overline{VSYNC}$ and $\overline{HSYNC}$ are inputs, and synchronous to external signals |
| 0 | 1 | $\overline{VSYNC}$ is an input, and synchronous to external signals, while $\overline{HSYNC}$ is an output |
| 1 | 0 | non-used |
| 1 | 1 | $\overline{VSYNC}$ and $\overline{HSYNC}$ are outputs |

(3) bit 6 (SB) . . . sprite blanking

It is decided whether a sprite should be displayed on a screen or not. The control of the bit is effective in the following horizontal display period.

(3.1) "0" . . . blanking of a sprite (3.2) "1" . . . display of a sprite (4) bit 7 (BB) . . . background blanking It is decided whether background should be displayed on a screen or not. The control of the bit is effective in the following horizontal display period.

(4.1) "0" . . . blanking of background (4.2) "1" . . . display of background

As a result, when the bits 6 and 7 are both "0", there is resulted in "burst mode" in which the following operations can be performed.

(3.4.1) The access to the VRAM 7 is not performed for a display, but the VRAM 7 is accessed by the CPU 2.

(3.4.2) DMA between two regions of the VRAM 7 is possible to be performed at any time.

In such an occasion, the terminals VD0 to VD 7 are all "L", while the SPBG terminal is "H".

On the other hand, when the bits 6 and 7 are both "1", there is released from the "burst mode".

(5) bits 8 and 9 (TE) . . . selection of DISP terminal outputs

| bit 9 | bit 8 | DISP output | Content |
|---|---|---|---|
| 0 | 0 | DISP | output "H" during display |
| 0 | 1 | BURST | color burst inserting position is indicated by output "L" |
| 1 | 0 | INTHSYNC | internal horizontal synchronous signal |
| 1 | 1 | | non-used |

(6) bit 10 (DR) . . . dynamic RAM refresh

Refresh address is supplied from the terminals MA0 to MA15 upon the setting of the bit in a case where a VRAM number of dot periods is of 2 dots or 4 dots for background in a memory width register as shown in FIG. 3K.

(7) bits 11 and 12 (IW) . . . increment width selection of the memory address write register or memory address read register A width which is incremented in address is selected as follows.

| bit 12 | bit 11 | increment width |
|---|---|---|
| 0 | 0 | +1 |
| 0 | 1 | −20H |
| 1 | 0 | +40H |
| 1 | 1 | −80H |

In a case of 8 bit access, an address is incremented upon the access of the upper byte.

(h) Raster detecting register (register number "06", FIG. 3H)

A raster number "RCR" at which an interruption job is performed is written into the raster detecting register. An interruption signal is produced when a value of a raster counter is equal to the raster number "RCR". The raster counter is preset to be "64" at a preceding scanning raster line to a display starting raster line as described in more detail later, and is increased at each raster line by one.

(i) BGX scroll register (register number "07", FIG. 3I)

The BGX scroll register is used for a horizontal scroll of background on a screen. When a content "BXR" is re-written therein, the content is effective in the following raster line.

(j) BGY scroll register (register number "08", FIG. 3J)

The BGY scroll register is used for a vertical scroll of background on a screen. When a content "BYR" is re-written therein, the content is effective to be as "BYR+1" in the following raster line.

(k) Memory width register (register number "09", FIG. 3K)

(1) bits 0 and 1 (VM) . . . VRAM dot width

A number of dot periods in which an access to the background attribute table and character generator, DMA and access of the CPU2 to the VRAM 7 during a horizontal display period are performed is written into the bits of the memory width register. The dot width is dependent on a memory speed of the VRAM 7. When the bits 0 and 1 are re-written therein, the content is effective at the beginning of a vertical retrace period.

| bit 1 | bit 0 | dot width | Disposition in one character cycle (8 dots) 1 | 2 | 3 | 4 | 5 | 6 | 7 | 8 |
|---|---|---|---|---|---|---|---|---|---|---|
| 0 | 0 | 1 | CPU | BAT | CPU | | CPU | CG0 | CPU | CG1 |
| 0 | 1 | 2 | BAT | | CPU | | CG0 | | CG1 | |
| 1 | 0 | 2 | BAT | | CPU | | CG0 | | CG1 | |
| 1 | 1 | 4 | BAT | | | | CG0/CG1 | | | |

"BAT" is for background attribute table, and "CG" is for character generator.

(2) bits 2 and 3 (SM) . . . sprite number of dot periods

A number of dot periods in which an access to the sprite generator is performed during a horizontal retrace period is written into the bits of the memory width register.

| bit 3 | bit 2 | dot width | Disposition in one character cycle (8 dots) 1 | 2 | 3 | 4 | 5 | 6 | 7 | 8 |
|---|---|---|---|---|---|---|---|---|---|---|
| 0 | 0 | 1 | SP0 | SP1 | SP2 | SP3 | SP0 | SP1 | SP2 | SP3 |
| *0 | 1 | 2 | SP0 | | SP1 | | SP0 | | SP1 | |
| | | | SP2 | | SP3 | | SP2 | | SP3 | |
| 1 | 0 | 2 | SP0 | | SP1 | | SP2 | | SP3 | |
| **1 | 1 | 4 | | SP0 | | | | SP1 | | |
| | | | | SP2 | | | | SP3 | | |

(3) bits 4 to 6 (SCREEN)

The number of characters in X and Y directions of a fictitious screen is decided dependent on the content of the bits. When a content is re-written into the bits, the content is effective at the beginning of a vertical retrace period.

| bit 6 | bit 5 | bit 4 | Number of characters X | Y |
|---|---|---|---|---|
| 0 | 0 | 0 | 32 | 32 |
| 0 | 0 | 1 | 64 | 32 |
| 0 | 1 | 0 | 128 | 32 |
| 0 | 1 | 1 | 128 | 32 |
| 1 | 0 | 0 | 32 | 64 |
| 1 | 0 | 1 | 64 | 64 |
| 1 | 1 | 0 | 128 | 64 |
| 1 | 1 | 1 | 128 | 64 |

(4) bit 7 (CM) . . . CG mode

When a VRAM number of dot periods is of 4 dots, a color block of a character generator is changed dependent on the bit. When a content is written into the bit, the content is effective in the following raster line.

(l) Horizontal synchronous register (register number "OA", FIG. 3L)

(1) bits 1 to 4 (HSW) . . . horizontal synchronous pulse

A pulse width of "L" level of a horizontal synchronous pulse is set as an unit of a character cycle. One of 1 to 32 is selected by using 5 bits to comply with a specification of a CRT display.

(2) bits 8 to 14 (HDS) . . . staring position of horizontal display

A period between a rising edge of a horizontal synchronous signal and a starting time of a horizontal display is set as an unit of a character cycle. An optimum position in the horizontal direction on a CRT display is decided by a content of the 7 bits. When it is assumed that a horizontal display position (horizontal back porch) is "N", "N-1" is written into the HDS bits.

(m) Horizontal display register (register number "OB", FIG. 3M)

(1) bits 0 to 6 (HDW) . . . horizontal display width

A display period in each raster line is set as an unit of a character cycle, and is decided in accordance with the number of characters in the horizontal direction on a CRT screen dependent on a content of the 7 bits. If it is assumed that a horizontal display position is "N", "N-1" is written into the HDW bits.

(2) bits 8 to 11 (HDE) . . . horizontal display ending position

A period between an ending of a horizontal display period and a rising edge of a horizontal synchronous signal is set as an unit of a character cycle. An optimum position of a horizontal display is set on a CRT display by the 7 bits. When it is assumed that a horizontal display ending position (horizontal back porch) is "N", "N -1" is written into the HDE bits.

(n) Vertical synchronous register (register number "OC", FIG. 3N)

(1) bits 0 to 4 (VSW) . . . vertical synchronous pulse width

A pulse width of a vertical synchronous signal is decided in a width of "L" level as an unit of a raster line. One of 1 to 32 is selected to comply with a specification of a CRT display.

(2) bits 8 . . . vertical display starting position

A period between a rising edge of a vertical synchronous signal and a vertical synchronous starting position is set as an unit of a raster line. When it is assumed that a vertical display starting position (vertical back porch) is "N", "N-2" is written into the bits.

(o) Vertical display register (register number "OD", FIG. 30)

A vertical display period (display region) is set as an unit of a raster line. A vertical display width is decided in accordance with the number of raster lines to be displayed on a CRT display which is defined by a content of the 9 bits. When it is assumed that a vertical display width is "N", "N-1" is written into the VDW bits.

(p) Vertical display ending position register (register number "OE", FIG. 3P)

A period between a vertical display ending position and a rising edge of a vertical synchronous signal is set as an unit of a raster line. When it is assumed that a vertical optimum position (vertical front porch) is "N" to be defined by the 8 bits, "N" is written into the VCR bits.

(q) DMA control register (register number "OF", FIG. 3Q)

(1) bit 0 (DSC) . . . enable of interruption at the finishing of transfer between the VRAM7 and sprite attribute table buffer 23.

It is decided whether or not an interruption is enabled at the finishing time of the transfer.

(1.1) "0" . . . disable (1.2) "1" . . . enable (2) bit 1 (DVC) . . . enable of interruption at the finishing of transfer between two regions of the VRAM 7.

It is decided whether or not an interruption is enabled at the finishing time of the transfer.

(2.1) "0" . . . disable (2.2) "1" . . . enable (3) bit 2 (SI/D) . . . increment/decrement of a source address One of automatical increment and decrement of a source address is selected in a transfer between two regions of VRAM 7.

(4.1) "0" . . . increment (4.2) "1" . . . decrement (5) bit 5 (DSR) . . . repetition of a transfer between the VRAM 7 and sprite attribute table buffer 23.

It is decided whether or not a repetition of a transfer between the VRAM 7 and sprite attribute table buffer 23 is enabled.

(r) DMA source address register (register number "10", FIG. 3R)

A starting address of a source address is allocated in a transfer between two regions of the VRAM 7.

(s) DMA destination address register (register number "11", FIG. 3S)

A starting address of a destination address is allocated in a transfer between two regions of the VRAM7.

(t) DMA block length register (register number "12", FIG. 3T)

A length of a block is defined in a transfer between two regions of the VRAM 7.

(u) DMA VRAM-SATB source address register (register number "13", FIG. 3U)

A starting address of a source address is allocated in a transfer between the VRAM7 and sprite attribute table buffer 23.

Figure 4A:
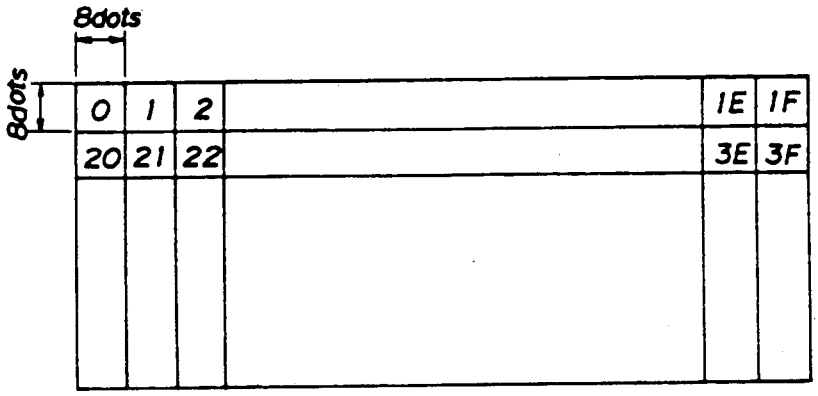
FIG. 4A is an explanatory diagram showing a fictitious screen in the apparatus of FIG. 1.

In FIG. 4A, there is shown an address in a background attribute table for a character on a fictitious screen. A character and color to be displayed at each character position are stored in the background attribute table. A predetermined number of background attribute tables are stored in a region the first address of which is "0" in the VRAM 7. The fictitious screen shown therein which is one example is of 32×32 characters (1F=32).

Figure 4B:
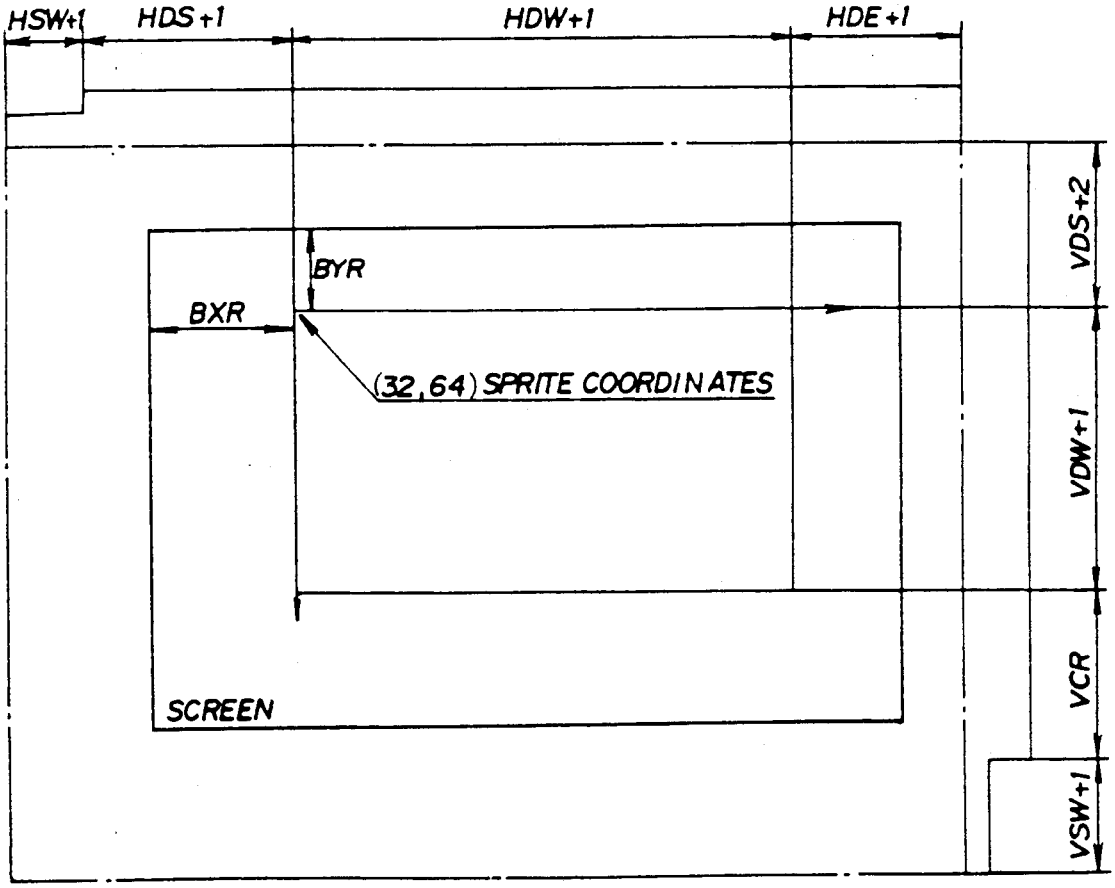
FIG. 4B is an explanatory diagram showing a display region on a screen in the apparatus of FIG. 1, FIGS. 5A and 5B are explanatory diagrams showing a background attribute table in the VRAM in the apparatus of FIG. 1, FIGS. 6A and 6B are explanatory diagrams showing a sprite attribute table in the VRAM in the apparatus of FIG. 1.

In FIG. 4B, there is shown a screen which is framed by writing respective predetermined values into the aforementioned horizontal synchronous register, horizontal display register, vertical synchronous register and vertical display register as shown in FIGS. 3L, 3M, 3N and 30. Although the respective predetermined values for the registers are not explained here, a display region is defined in accordance with "HDW+1" in the horizontal display register and "VDW+1" in the vertical display register. In the embodiment, the starting coordinates (x,y) for the display region is indicated to be as (32, 64).

Figures 5A, 5B:
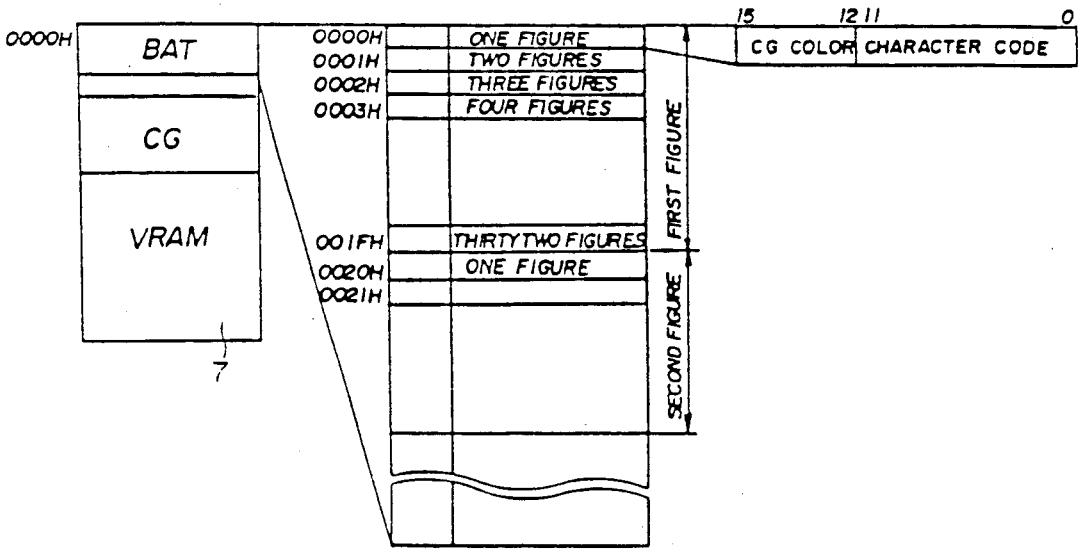

In FIGS. 5A and 5B, there are shown background attribute tables (BATs) in the VRAM 7 each of 16 bits to have a character code of lower 12 bits for designating a pattern number of a character and a CG color of upper 4 bits for designating a CG color code.

Figure 6A:
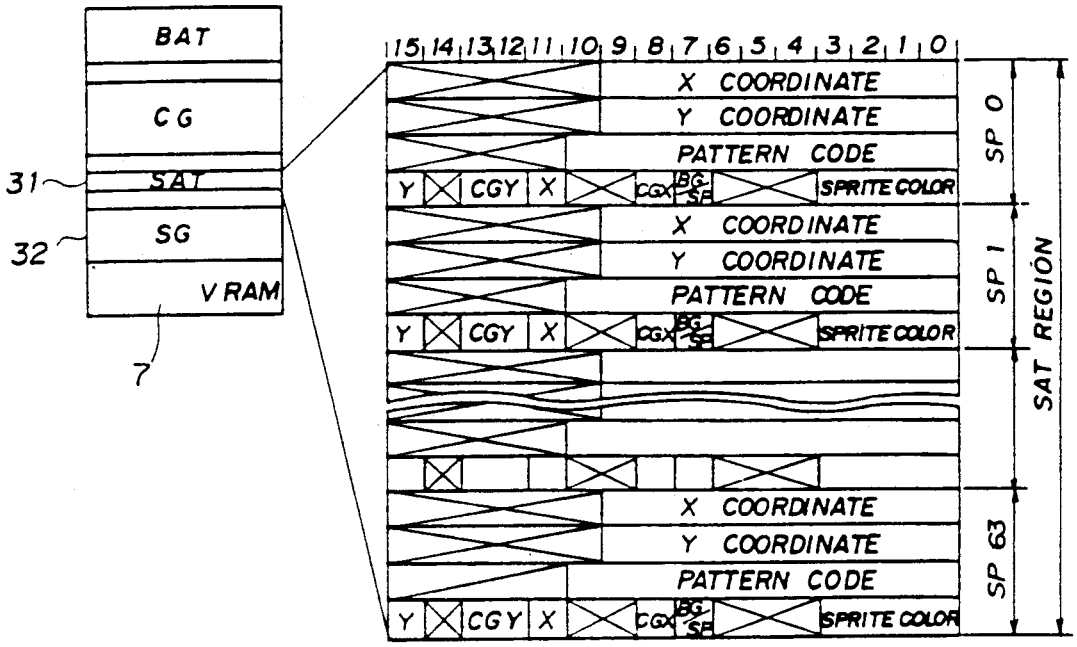
Figure 6B:
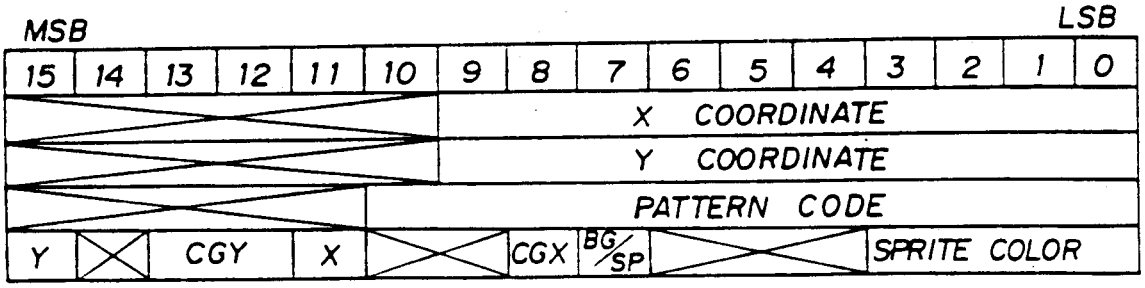

In FIGS. 6A and 6B, there are shown sprite attribute tables (SATs) 31 in the VRAM along with a sprite generator region 32. Each of the sprite attribute tables 31 is composed of 16×4 bits, that is, four words to define a sprite. Therefore, sixty-four sprites are defined by 256 words. In the sprite attribute table, lower 10 bits in the first word designate a horizontal position (0 to 1023) of a sprite. For this purpose, one of 0 to 1023 is written into an X coordinate therein. In the same manner, lower 10 bits in the second word designate a vertical position (0 to 1023) of a sprite, and one of 0 to 1023 is written into a Y coordinate therein. On the other hand, lower 11 bits in the third word is for a pattern number which is an address for a sprite generator 32, while the fourth word is for control bits including Y ($X_{15}$), CGY (two bits of $X_{13}$ and $X_{12}$), X ($\overline{X}_{11}$), CGX($X_8$), BG/SP ($X_7$) and a color for a sprite (four bits of $X_3$ to $X_0$) in the direction of MSB to LSB.

The control bits are defined as follows.

(1) setting of $\overline{Y}$

A sprite is displayed to be reversed in the Y direction.

(2) setting of CGX

Two sprites consisting of a sprite to be addressed in the sprite generator 32 and the other sprite of the following address are displayed to be joined in the horizontal direction.

(3) setting of X

A sprite is displayed to be reversed in the X direction.

(4) setting of CGY

The two bits $X_{13}$ and $X_{12}$ define three modes to be described in more detail later.

| | | |
|---|---|---|
| 0 | 0 | Normal |
| 0 | 1 | 2 CGY |
| 1 | 0 | non-used |
| 1 | 1 | 4 CGY |

(5) BG/SP

The bit $X_7$ designates a priority between displays of a background and sprite.

(5.1) "0" . . . background (5.2) "1" . . . sprite (6) sprite color

The bits $X_3$ to $X_0$ designate an area color of a sprite.

Each sprite has four facets to be called SG0 to SG3 each being of 16×16 dots so that one sprite occupies 64 words.

The writing of data into a sprite attribute table 31 is performed such that the data are not transferred from the CPU 2 directly to the VRAM 7, but in DMA transfer from the CPU2 to the sprite attribute table buffer 23.

Figure 7:
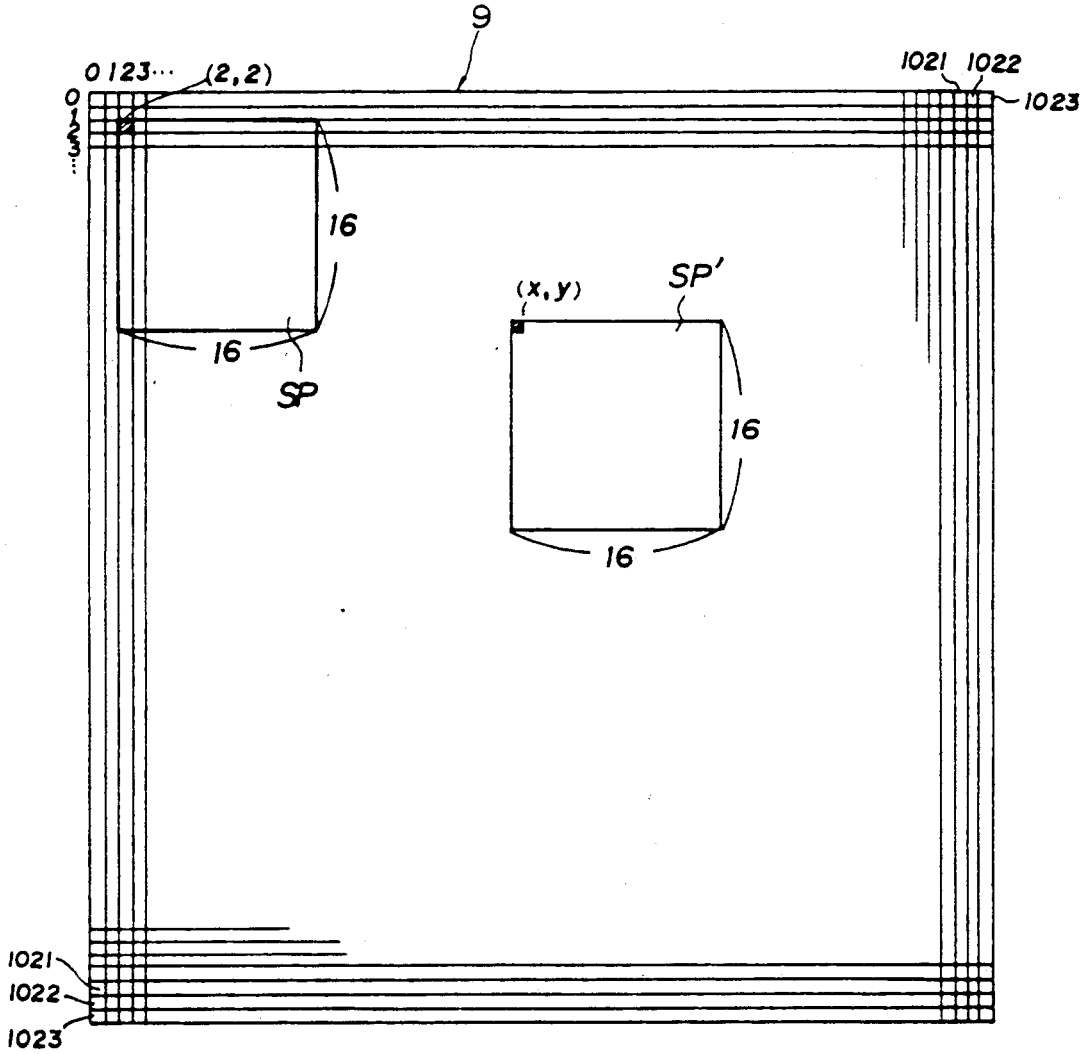
FIG. 7 is an explanatory diagram explaining an operation in which a sprite is moved on a screen in the apparatus of FIG. 1.

Before explaining an apparatus for the control of an access to a video memory in an embodiment according to the invention, an operation in which a sprite is displayed on a screen will be described. Now, a sprite SP having standard coordinates (2,2) is displayed on a display screen 9 having 1024 display dots respectively in the X and Y directions as shown in FIG. 7. In displaying the sprite SP thereon, the Y coordinates of the sixty-four sprite attribute tables 31 are compared in turn with a raster signal supplied from the scanning raster signal producing circuit 33 at the coincidence detection circuit 34 to pick up sprites each having a Y coordinate "2" which is then stored in its sprite number among the sprite numbers 0 to 63 into the pattern code buffer 35 when a horizontal display period of a scanning raster number "1" is started in the apparatus as shown in FIG. 2B. In this occasion, sixteen of sprites can be stored in the pattern code buffer 35 at the maximum. During a horizontal retrace period before which a scanning raster number "1" is finished and after which a scanning raster number "2" is started, address signals are produced in the selector 36 in accordance with the sprite numbers stored in the pattern code buffer 35 and pattern codes in the sprite attribute tables 31 so that pattern data are read from the sprite generator 32 in accordance with the address signals thus produced. The pattern data are stored in the pattern data buffer 37 along with X coordinates corresponding thereto in the sprite attribute tables 31. When a horizontal display period of the scanning raster number "2" is started, the X coordinates stored in the pattern data buffer 37 are compared with counted values of the horizontal dot clock counter 38 at the coincidence detection circuit 39. In the comparison, pattern data for the sprite sp are read to be supplied to the parallel/serial converting circuit 40 from the pattern data buffer 37 when the counted value corresponds to x=2. The parallel pattern data are converted into serial pattern data in the parallel/serial converting circuit 40 so that a picture element (2, 2) of the sprite sp is displayed on the CPT screen 9 in accordance with the serial pattern data passed through the gate circuit 42. Thereafter, fifteen picture elements (3, 2), (4, 2) . . . (17, 2) are displayed thereon to complete the display of the sprite sp on the y=2 raster line. As a matter of course, control data of the sprite attribute table 31 corresponding to the sprite sp are used to control the display thereof. In moving the sprite sp having the standard coordinates (2, 2) to a display position having a standard coordinates (X, Y) to be a sprite sp', the X and Y coordinates (2, 2) of the sprite attribute table 31 corresponding to the sprite sp are only changed to be X and Y coordinates (x, y) without changing contents of the sprite generator 32 and necessitating the re-definition of a pattern. The sprites sp and sp' are displayed in accordance with the combination of more than one facets among the four facets SG0 to SG3.

Figure 8:
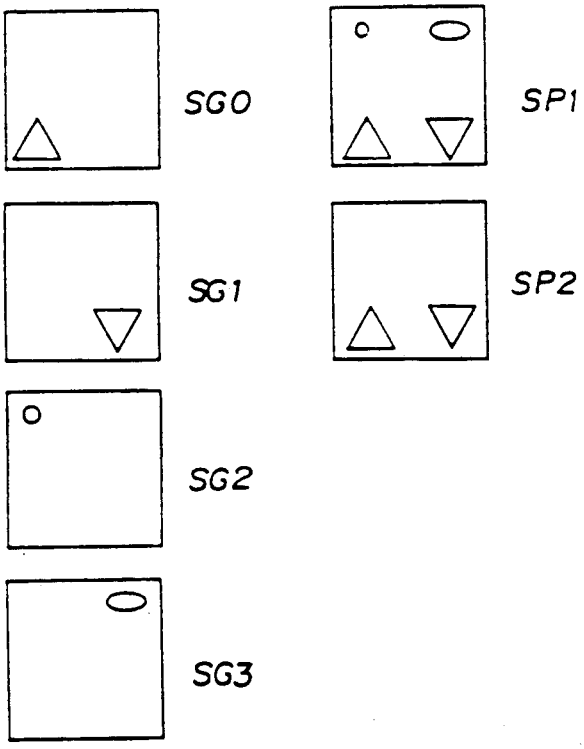
FIG. 8 is an explanatory diagram explaining an operation in which a plurality of facets are combined to provide a sprite in the apparatus of FIG. 1.

Such a combination of facets SG0 to SG3 is shown in FIG. 8. For instance, all of the four facets SG0 to SG3 are combined to display a sprite Sp, while the facets SG0 and SG1 are combined to display a sprite $sp_2$. As clearly understood from the example, 24 display patterns are obtained in accordance with the calculation "4×3×2=24" so that a desired pattern can be selected from the 24 patterns in accordance with control data in a sprite attribute table. The four facets SG0 to SG3 are of different colors each to be designated by an area color code.

Figure 9:
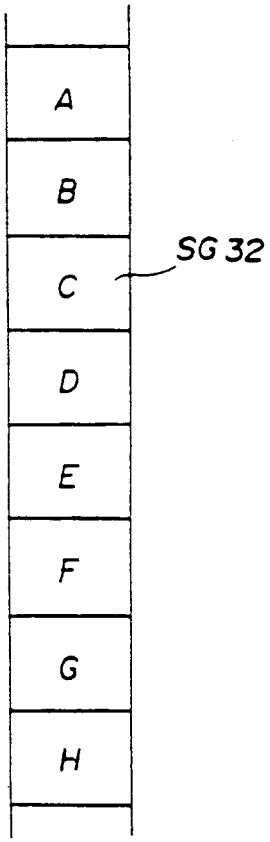
FIG. 9 is an explanatory diagram showing a sprite generator in the apparatus of FIG. 1, FIGS. 10A to 10E are explanatory diagrams showing an operation in which a size of a sprite is enlarged in the apparatus of FIG. 1.
Figure 10A:
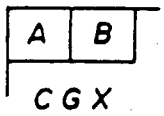
Figure 10B:
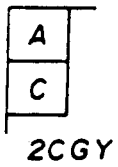
Figure 10C:
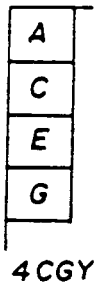
Figure 10D:
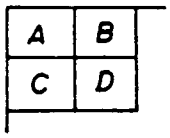
Figure 10E:
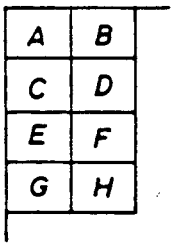

Next, the aforementioned CGX and CGY defined by control data in a sprite attribute table 31 are explained. In FIG. 9, there is shown a sprite generator (SG) 32 comprising pattern data A, B, C . . . In accordance with the definition of CGX and CGY as explained before, various kinds of sprite patterns each having a different color and size from others are obtained without increasing a memorizing area of the sprite generator 32 as shown in FIGS. 10A to 10E.

Figures 11A, 11B:
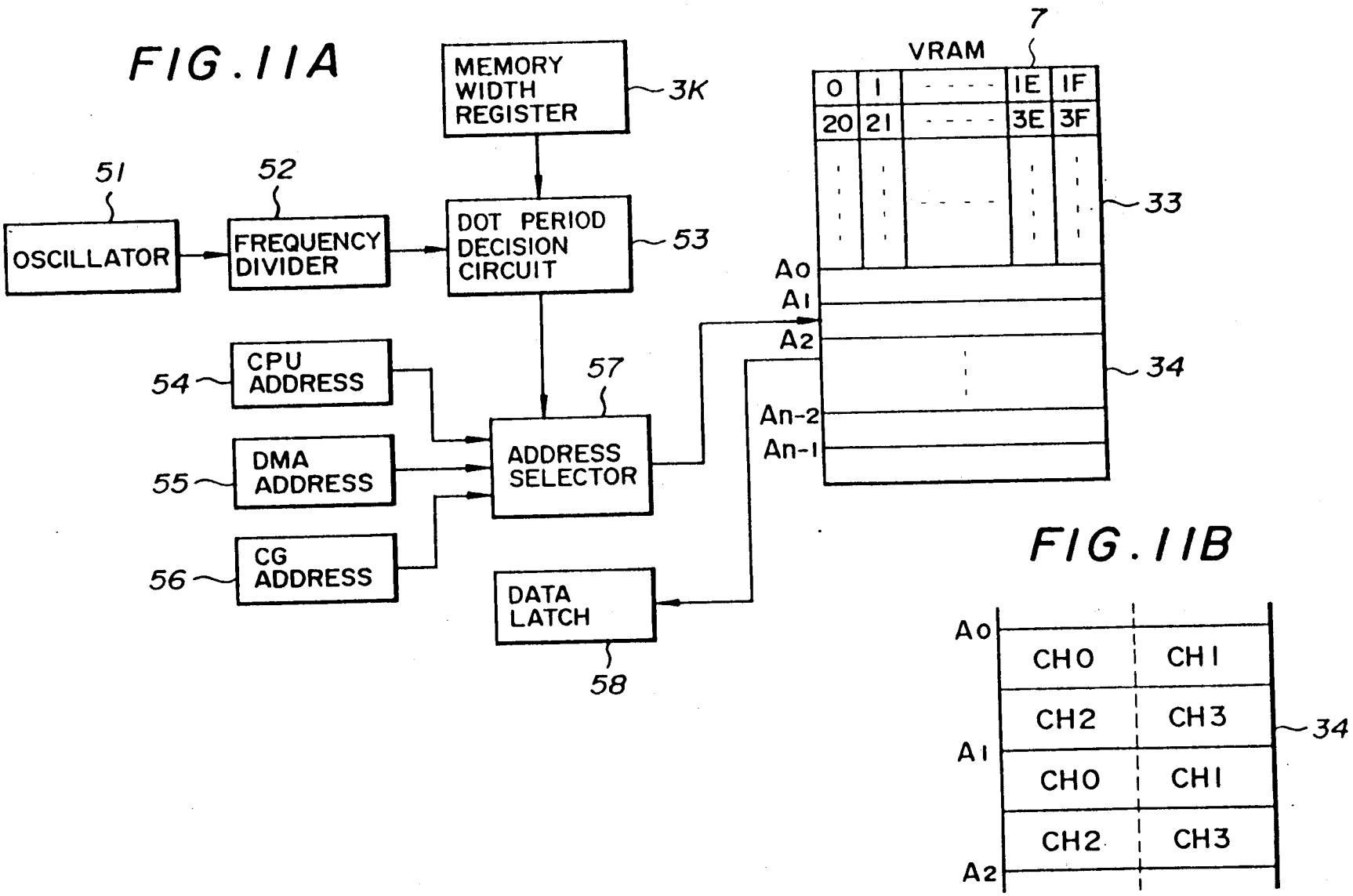
FIG. 11A is a block diagram showing an apparatus for the control of an access to a video memory in an embodiment according to the invention.
FIG. 11B is an explanatory diagram showing a character generator in the apparatus of FIG. 11A, and FIGS. 12 and 13 are timing charts showing operations in the apparatus of FIG. 11A and a conventional apparatus for the control of an access to a video memory respectively.

In FIG. 11A , there is shown an apparatus for the control of an access to a video memory in an embodiment according to the invention. The apparatus for the control of an access to a video memory comprises an oscillator 51 for producing oscillation signals, a frequency divider 52 for dividing a frequency of the oscillation signals by a predetermined dividing ratio to produce dot clock signals, a memory width register 3K as already explained in FIG. 3K having a content of a number of dot periods dependent on a memory speed of the VRAM 7, a number of dot periods decision circuit 53 for deciding a dot width in accordance with the content of the memory width register 3K, means 54, 55 and 56 for producing a CPU address signal, DMA address signal and CG address signal respectively to designate addresses in an access to the VRAM 7, an address selector 57 for selecting an address at an access timing which is set by the number of dot periods decision circuit 53, and a data latch circuit 58 for latching data read from the VRAM 7. The VRAM 7 is shown in FIG. 11A to include a VRAM region 33 of a fictitious screen as described in FIG. 4A and a character generator region 34 which is also shown in FIG. 11B. One character of the character generator region 34 is composed of four facets CH0 Ch1, CH2 and CH3 each having 8×8 dots by which a pattern is defined by sixteen words of eight words for the facets CH0 and CH1 and other eight words for the facets CH2 and CH3. The characters are addressed by the first addresses of the facets CHOs shown by $A_0$, $A_1$, $A_2$... which are defined by character codes of background attribute tables as described in FIGS. 5A and 5B.

In operation, when a horizontal display of the scanning raster number "0" is started, the VM bits of the memory width register 3K are checked by the number of dot periods decision circuit 53. If it is assumed that a content of the VM bits is "00", a number of dot periods of an access to the VRAM 7 is decided to be "1" as defined in the table on page 19. Accordingly, the VRAM 7 is accessed in accordance with a CPU address signal from the CPU address signal means 54 under the control of the address selector 57 at the first dot timing among eight dots of one character cycle. Next, the VRAM region 33 of the VRAM 7 is accessed at an address "0" in accordance with a CG address signal from the character generator address signal means 56 at the second dot timing. At this moment, a character code and a CG color are read from a background attribute table, as shown in FIGS. 5A and 5B, of the address "0". Thereafter, accesses are performed from the CPU 2 (FIG. 1) to the VRAM 7 at the third and fifth dot timings except for the fourth dot timing, and the character generator region 34 is accessed at the sixth dot timing. In the access to the character generator region 34, a CG address signal of the CG address signal means 56 is determined in accordance with a pattern number corresponding to a character code which is previously checked whereby display data are read from the facets CH0 and CH1 thereof. After the seventh dot timing, display data are further read from the facets CH2 and CH3 in accordance with the same address signal at the eight dot timing. As a result, one character is formed in accordance with the display data of the four facets CH0 to CH3 which are latched in the data latch circuit 58. A display of the address "0" is performed on the CRT 9 (FIG. 1) in accordance with the data thus latched in the data latch circuit 58 wherein a color of the display is determined by the CG color in the background attribute table. In the horizontal displays which follow the horizontal display of the scanning raster line "0", the same operation as explained above will be repeated.

On the other hand, if it is assumed that a content of the VM bits is "01", "10" or "11", the VRAM 7 is accessed with a number of dot periods is "2", "2" or "4". For this reason, a content of the VM bits is determined dependent on a memory speed of the VRAM 7.

Figure 12:
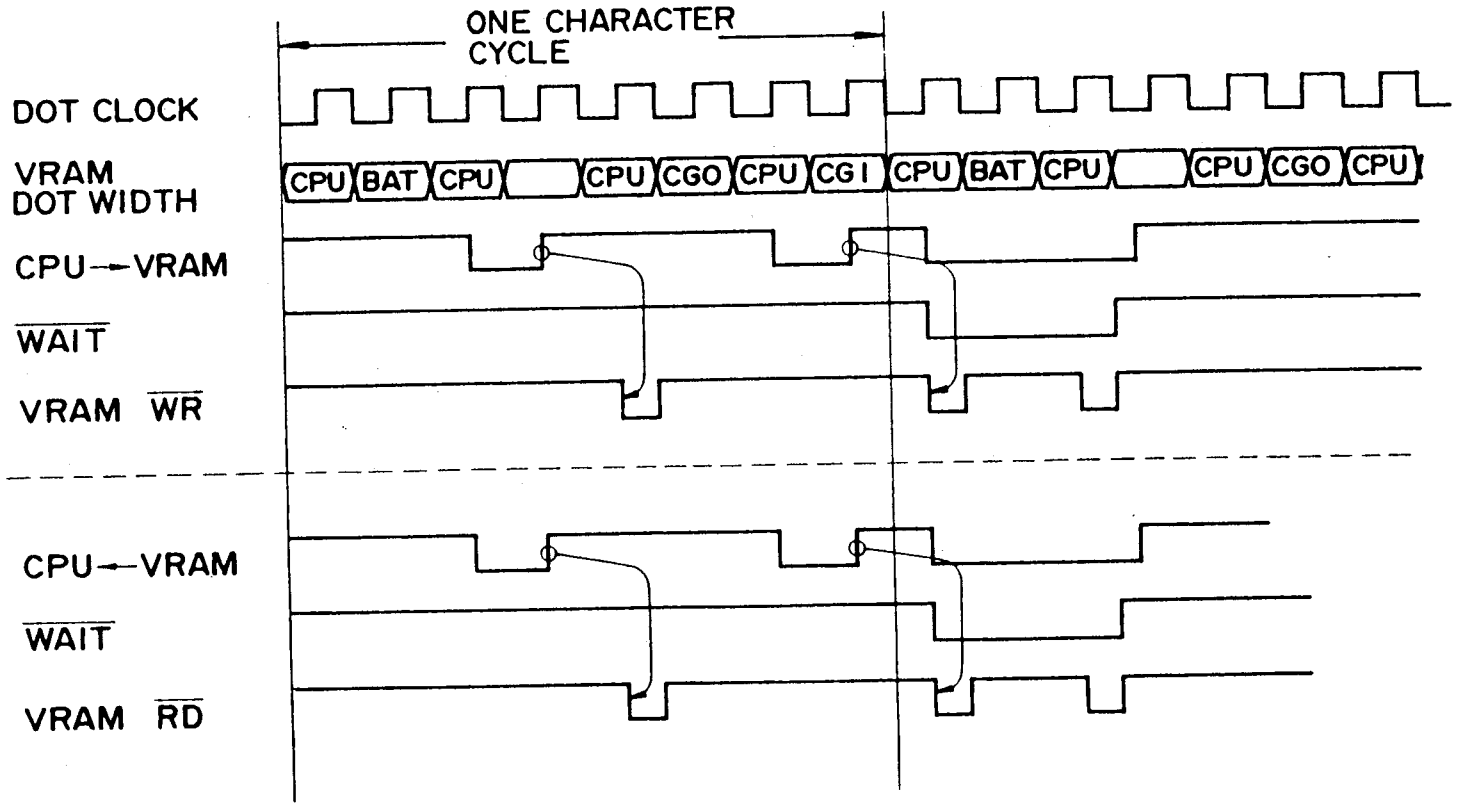

In another operation, it is assumed that a content of the VM bits is "00" in the memory width register 3K to provide a number of dot periods of one dot, and that a content of the IW bits is "00" in the control register as shown in FIG. 3G to provide an address increment width "1". An operation in which data are written into the VRAM 7 is started after the first address for writing the data is written into the memory address write register as shown in FIG. 3C. When the VRAM 7 is accessed from the CPU 2 as shown in FIG. 12 by the indication "CPU→VRAM", the data are held in the CPU read/write buffer 22 (FIG. 2A), if the writing of the data is collided in regard to its timing with a display cycle of the VRAM 7. For this reason, the CPU2 is released from the writing of the data as changed from "0" to "1" in regard to a timing chart of "CPU →VRAM". Thereafter, when the display cycle of the VRAM 7 is finished, the data thus held in the CPU read/write buffer 22 are written, as shown by the indication "VRAM $\overline{WR}$", into the VRAM 7 at the address which is designated by the memory address write register of FIG. 3C. At this moment, a content of the memory address write register is incremented by one. On the other hand, in a case where the VRAM 7 is accessed from the CPU2 when data are held in the CPU read/write buffer 22, the condition "$\overline{WAIT}$" becomes effective in the CPU2 so that a wait signal is produced at the $\overline{BUSY}$ terminal connected to the control unit 20 (FIG. 2A). Therefore, the condition "$\overline{WAIT}$" is much decreased in the number of occurrences in accordance with the provision of the CPU read/write register 22.

In the same manner as described above, the VRAM 7 is accessed from the CPU2 so that data are read from the VRAM as shown in FIG. 12 by the indication "CPU ←VRAM". Data which are read from the VRAM 7 at an address designated by the memory address read register as shown in FIG. 3D are once held in the CPU read/write buffer 22, when the access to the VRAM7 is collided with the display cycle of the VRAM7. When the display cycle of the VRAM7 is finished, the data thus held in the CPU read/write buffer 22 are transferred to the CPU2 as shown by the indication "VRAM $\overline{RD}$". At this moment, a content of the memory address read register is incremented by one.

Figure 13:
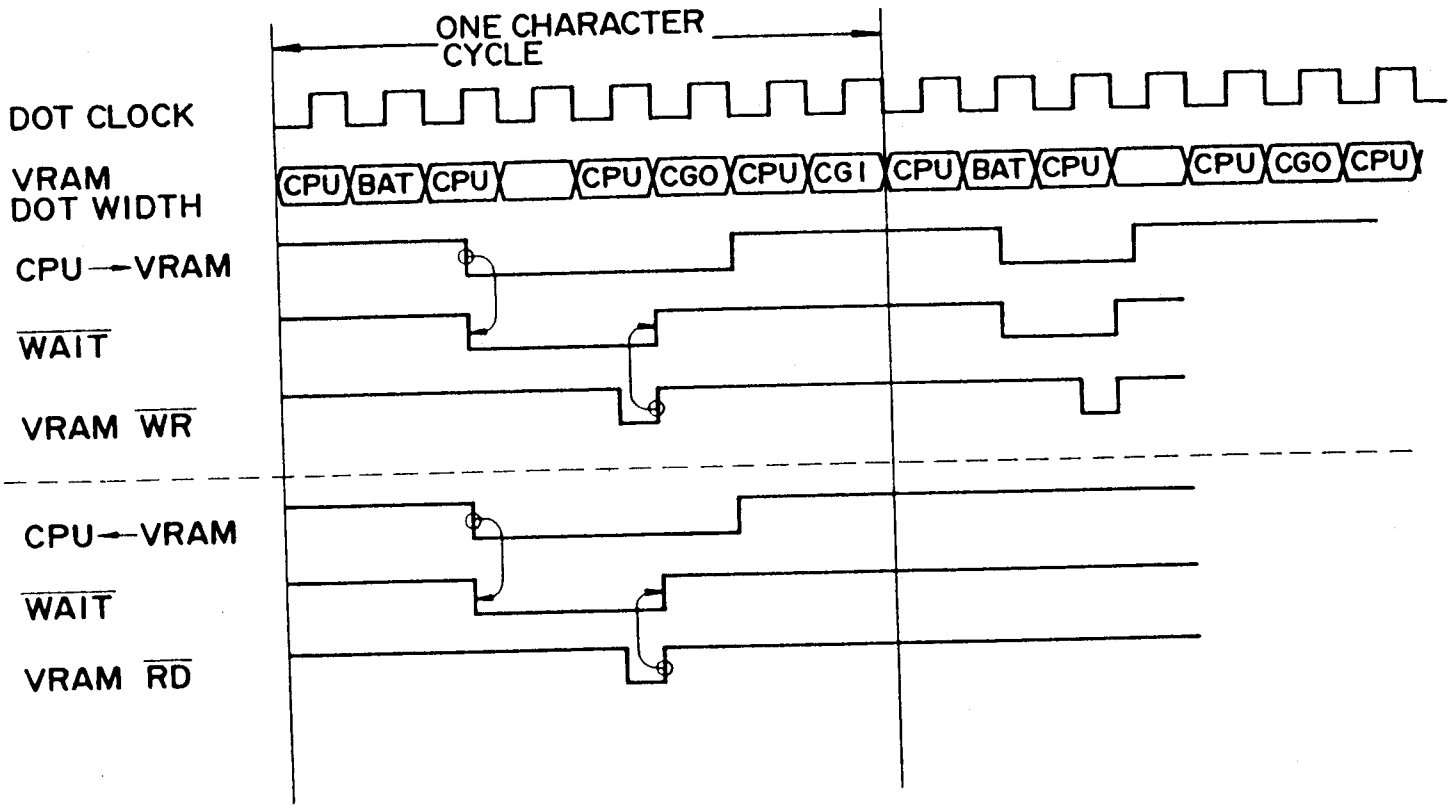

Otherwise, if the CPU read/write register 22 is not provided, the condition "WAIT" is increased in the number of occurrences as shown in FIG. 13 so that a throughput of the CPU2 is decreased. In more detail, the condition "$\overline{WAIT}$" is continued in the CPU2 until the display cycle of the VRAM7 is finished, when the VRAM7 is accessed from the CPU2 for the writing of data (CPU→VRAM) and the reading thereof (CPU←VRAM) during that cycle. When the display cycle of the VRAM 7 is finished, data are written into the VRAM 7 as shown by the indication "VRAM $\overline{WR}$", and read from the VRAM as shown by the indication "VRAM $\overline{RD}$" whereby flickers are prevented from being occured on a screen.

Although the invention has been described with respect to specific embodiment for complete and clear disclosure, the appended claims are not to thus limited but are to be construed as embodying all modification and alternative constructions that may occur to one skilled in the art which fairly fall within the basic teaching herein set forth.

What is claimed is:

1. An apparatus for the control of an access to a video memory comprising:

register means for storing a number of dot periods within a character cycle for processing the video memory;

means for deciding said number of dot periods in accordance with said content of said register means;

means for addressing said video memory at timings determined in accordance with said number of dot periods; and means for latching video data read from said video memory at said timings, wherein a pattern defined by said video data is displayed on a display screen.

2. An apparatus for the control of an access to a video memory according to claim 1, wherein said video data are read from a character generator in said video memory, and said character generator is addressed in accordance with a character code stored in a background attribute table included in said video memory.

3. An apparatus for the control of an access to a video memory according to claim 2, wherein said character generator includes four facts which are combined to define said pattern.

4. An apparatus for the control of an access to a video memory according to claim 2.

further comprising buffer means for storing said video data which are read from said video memory during a display cycle of said video memory, said video data being stored until said display cycle of said video memory is finished.

5. An apparatus for the control of an access to a video memory according to claim 1, wherein said means for deciding said number of dot periods includes means for generating a frequency having a period equal to said dot period.

6. An apparatus for the control of an access to a video memory according to claim 5 wherein said means for generating a frequency having a period equal to said dot period includes an oscillator circuit and a frequency divider.

7. An apparatus for the control of an access to a video memory according to claim 1. wherein said means for addressing said video memory includes:

a plurality of address registers; and address selector means responsive to said means for deciding said number of dot periods for selecting one of said address registers to be a selected address register and addressing said video memory in response to a content of said selected address register.

8. An apparatus for the control of an access to a video memory according to claim 7, wherein said means for deciding said number of dot periods includes means for generating a frequency having a period equal to said dot period.

9. An apparatus for the control of an access to a video memory according to claim 8, wherein said means for generating a frequency having a period equal to said dot period includes an oscillator circuit and a frequency divider.

10. An apparatus for the control of an access to a video memory comprising;

a video memory for storing video data;

means for addressing said video memory;

buffer means for storing video data to be written into said video memory and to be read out from said video memory; and means for controlling said buffer means to store said video data, and producing a wait signal to suspend an accessing of said addressing means to said video memory, wherein said controlling means controls said buffer means to store said video data without producing said wait signal, when said video memory is addressed for a display cycle of said video memory, said controlling means controls said addressing means to access said video memory to transfer said video data stored in said buffer means when said display cycle is finished, and said controlling means generates said wait signal when said video memory is to be accessed by said addressing means during a period when said video data is stored in said buffer means.

11. An apparatus for the control of an access to a video memory according to claim 10, wherein said video memory includes timing means for generating a frequency having a period equal to said dot period.

12. An apparatus for the control of an access to a video memory according to claim 11, wherein said timing means includes an oscillator circuit and a frequency divider.

13. An apparatus for the control of an access to a video memory according to claim 10, wherein said means for addressing said video memory includes:

a plurality of address registers; and address selector means responsive to a timing signal having a frequency with a period equal to a dot period for selecting one of said address registers to be a selected address register and addressing said video memory in response to a content of said selected address register.

14. An apparatus for the control of an access to a video memory according to claim 13, wherein said video memory includes timing means for generating said timing signal.

15. An apparatus for the control of an access to a video memory according to claim 14, wherein said timing means includes an oscillator circuit and a frequency divider.

* * * * *